US012305390B2

(12) United States Patent
Krick et al.

(10) Patent No.: US 12,305,390 B2
(45) Date of Patent: May 20, 2025

(54) SAG RESISTANT ACOUSTICAL CEILING PANEL WITH A FILLED LATEX BINDER SYSTEM THAT ENHANCES STRENGTH AND DURABILITY

(71) Applicant: ARMSTRONG WORLD INDUSTRIES, INC., Lancaster, PA (US)

(72) Inventors: Charles G Krick, Lititz, PA (US); Bartolo J Torre, Landisville, PA (US); Anthony L Wiker, Lancaster, PA (US); James D Pape, Columbia, PA (US)

(73) Assignee: AWI Licensing LLC, Wilmington, DE (US)

( * ) Notice: Subject to any disclaimer, the term of this patent is extended or adjusted under 35 U.S.C. 154(b) by 423 days.

(21) Appl. No.: 16/475,310

(22) PCT Filed: Jan. 10, 2018

(86) PCT No.: PCT/US2018/013122

§ 371 (c)(1),
(2) Date: Jul. 1, 2019

(87) PCT Pub. No.: WO2018/132447

PCT Pub. Date: Jul. 19, 2018

(65) Prior Publication Data

US 2019/0330847 A1 Oct. 31, 2019

Related U.S. Application Data

(60) Provisional application No. 62/446,658, filed on Jan. 16, 2017.

(51) Int. Cl.

| | |
|---|---|
| ***E04B 9/00*** | (2006.01) |
| ***D06N 3/00*** | (2006.01) |
| ***E04B 9/04*** | (2006.01) |
| ***E04B 9/24*** | (2006.01) |
| ***E04C 2/16*** | (2006.01) |

(52) U.S. Cl.
CPC ..... *E04C 2/16* (2013.01); *D06N 3/0011* (2013.01); *E04B 9/001* (2013.01); *E04B 9/04* (2013.01);
(Continued)

(58) Field of Classification Search
CPC ..... Y10T 428/24994; E04C 2/02–296; E04B 9/001; E04B 9/04; E04B 9/241;
(Continued)

(56) References Cited

U.S. PATENT DOCUMENTS 4,056,161 A * 11/1977 Allen, Jr. ..... G10K 11/168 181/290
5,565,062 A * 10/1996 Nass ..... D04H 1/587 162/168.3
(Continued)

FOREIGN PATENT DOCUMENTS

JP 02070860 A * 3/1990 ..... B29C 59/02

OTHER PUBLICATIONS

Machine Translation of Hirota et al. (JP-02070860-A) from Espacenet.com (Year: 1990).*
(Continued)

*Primary Examiner* — Larissa Rowe Emrich
(74) *Attorney, Agent, or Firm* — Patrick Sheldrake

(57) ABSTRACT

Described herein is a building panel comprising a body, the body comprising: a fiber; a latex binder present in an amount ranging from about 3 wt. % to about 10 wt. % based on the total weight of the body; and an inorganic particle having an average particle size ranging from about 1 micron to about 13 microns; wherein the inorganic particle and the binder are present in a weight ratio ranging from about greater than 1:1 to about 6:1.

18 Claims, 3 Drawing Sheets

(52) U.S. Cl.
CPC ..... *E04B 9/241* (2013.01); *D06N 3/0015* (2013.01); *D06N 2201/08* (2013.01); *D06N 2203/022* (2013.01); *D06N 2205/10* (2013.01); *D06N 2209/1685* (2013.01); *D06N 2211/06* (2013.01); *E04B 2103/04* (2013.01); *Y10T 428/24994* (2015.04)

(58) Field of Classification Search
CPC .... E04B 1/82–8236; E04B 1/84–8409; D06N 3/0011; D06N 3/0015; D06N 3/0022; D06N 2201/08; D06N 2205/10; D06N 2211/06; D04H 3/002–004; D04H 3/12; D04H 1/4209–4218; D04H 1/58; D04H 1/587; D04H 1/64
See application file for complete search history.

(56) References Cited

U.S. PATENT DOCUMENTS

2008/0003903 A1* 1/2008 Nandi ..... B32B 5/022 442/71
2009/0056898 A1* 3/2009 Wiker ..... D21J 1/16 162/218
2009/0126886 A1* 5/2009 Englert ..... D21H 13/40 162/151
2009/0173464 A1 7/2009 Baig
2009/0260918 A1* 10/2009 Cao ..... E04B 9/04 181/290
2010/0146887 A1 6/2010 Wiker et al.
2011/0147119 A1 6/2011 Cao et al.
2011/0284319 A1 11/2011 Frederick et al.
2013/0091682 A1 4/2013 Zhang et al.
2014/0248814 A1* 9/2014 Handermann ..... E04C 2/16 442/326

OTHER PUBLICATIONS

International Search Report from PCT/US2018/013122, mailed Apr. 23, 2018.

* cited by examiner

SAG RESISTANT ACOUSTICAL CEILING PANEL WITH A FILLED LATEX BINDER SYSTEM THAT ENHANCES STRENGTH AND DURABILITY

CROSS-REFERENCE TO RELATED APPLICATIONS

The present application is a U.S. National Stage application under 35 U.S.C. § 371 of PCT Application No. PCT/US2018/13122, filed Jan. 10, 2018, which in turn_claims the benefit of U.S. Provisional Application No. 62/446,658, filed on Jan. 16, 2017. The disclosure of the above application is incorporated herein by reference in their entirety.

BACKGROUND

Building panels—specifically acoustically pervious ceiling panels—have a tendency to sag when exposed to high-humidity environments. These building panels, which are formed from a combination of fiber and polymeric binder are put under added stress in high-humidity environments because the amount of water absorbed by the building panel increases. Previous attempts at improving sag-resistance in building panels including adding certain polymers that were better suited for avoiding or minimizing the amount of water that could be absorbed into the building panel when exposed to high-humidity environments. Such previous attempts, however, necessitated large amounts of such polymer in the building panel—thereby not only driving up the cost but also increasing the airflow resistance through the building panel. As airflow resistance increases, the building panel is less likely to be able to function as an acoustic pervious ceiling panel. Thus, there exists a need for building panels that exhibits the desired sag-resistance properties while minimizing cost concerns and still achieving the desired mechanical strength and airflow resistance needed for the building panel to function as an acoustically pervious ceiling panel.

BRIEF SUMMARY

The present invention is directed to a building panel comprising a body, the body comprising a fiber; a latex binder present in an amount ranging from about 3 wt. % to about 10 wt. % based on the total weight of the body; an inorganic particle having an average particle size ranging from about 1 micron to about 13 microns; wherein the inorganic particle and the latex binder are present in a weight ratio ranging from about 1:1 to about 6:1.

In other embodiments, the present invention includes a building panel comprising a body, the body comprising: an inorganic fiber in an amount ranging from about 70 wt. % to about 95 wt. % based on the total weight of the body; a latex binder in an amount ranging from about 3 wt. % to about 10 wt. %; and an inorganic particle present in an amount ranging from about 3 wt. % to about 30 wt. % based on the total weight of the body, wherein the inorganic particle has an average size ranging from about 1 micron to about 13 microns.

Other embodiments of the present invention include a method of forming a building panel comprising: a) adding inorganic particles to a mixture of inorganic fiber and water to form a first mixture; b) adding a latex binder to the first mixture to form a second mixture; and c) forming a dried body from the second mixture; wherein the inorganic particles have an average particle size of about 1 micron to about 13 microns, and the inorganic particles and the latex binder are present in the first mixture in a weight ratio ranging from about 1:1 to about 6:1.

Other embodiments of the present invention include a building panel comprising a body having a first major surface opposite a second major surface, the body comprising an inorganic fiber; a latex binder; an inorganic particle having an average size ranging from about 1 micron to about 13 microns; wherein the inorganic particle and the latex binder are present in a weight ratio ranging from about 1:1 to about 6:1, and wherein the body has an airflow resistance less than about 200 MKS rayls as measured between the first major surface and the second major surface.

In other embodiments, the present invention may include a building panel comprising a body, the body comprising: an inorganic fiber comprising mineral wool; a latex binder in an amount ranging from about 3 wt. % to about 8 wt. %; an inorganic particle comprising calcium carbonate having an average particle size of about 11 microns to about 15 microns; wherein the inorganic particle and the latex binder are present in a weight ratio of about 2.5:1 to about 3.5:1.

Other embodiments of the present invention include a building panel comprising a body, the body comprising: an inorganic fiber comprising mineral wool; a latex binder in an amount ranging from about 3 wt. % to about 8 wt. %; an inorganic particle comprising kaolin having an average particle size of about 3 microns to about 8 microns; wherein the inorganic particle and the latex binder are present in a weight ratio of about 1:1 to about 3.5:1.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
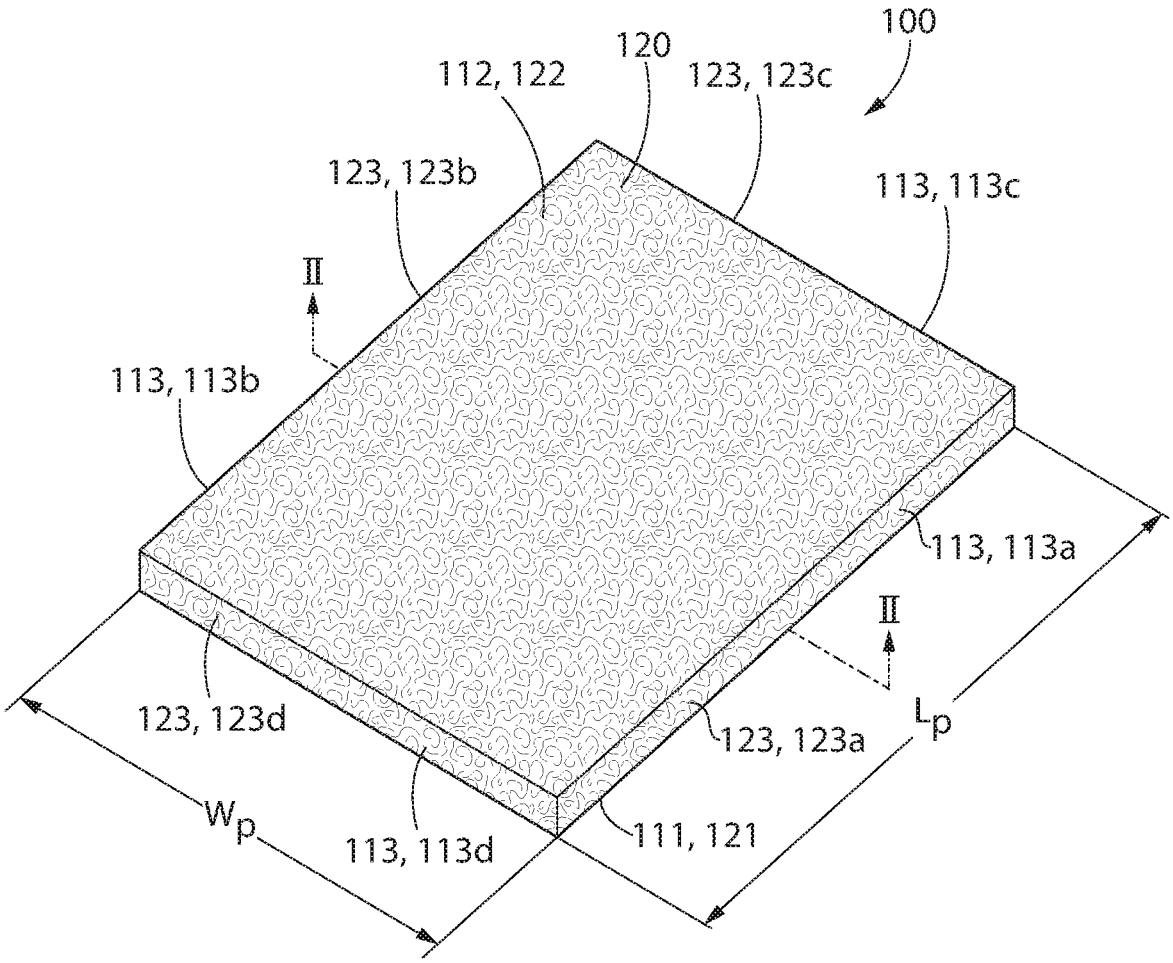
FIG. 1 is top perspective view of a building panel according to the present invention.

The following description of the preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top," and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such.

Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Unless otherwise specified, all percentages and amounts expressed herein and elsewhere in the specification should be understood to refer to percentages by weight. The amounts given are based on the active weight of the material. According to the present application, the term "about" means+/−5% of the reference value. According to the present application, the term "substantially free" less than about 0.1 wt. % based on the total of the referenced value.

Referring to FIG. 1, the building panel 100 of the present invention may comprise a first major surface 111 opposite a second major surface 112. The ceiling panel 100 may further comprise a side surface 113 that extends between the first major surface 111 and the second major surface 112, thereby defining a perimeter of the ceiling panel 100.

Figure 3:
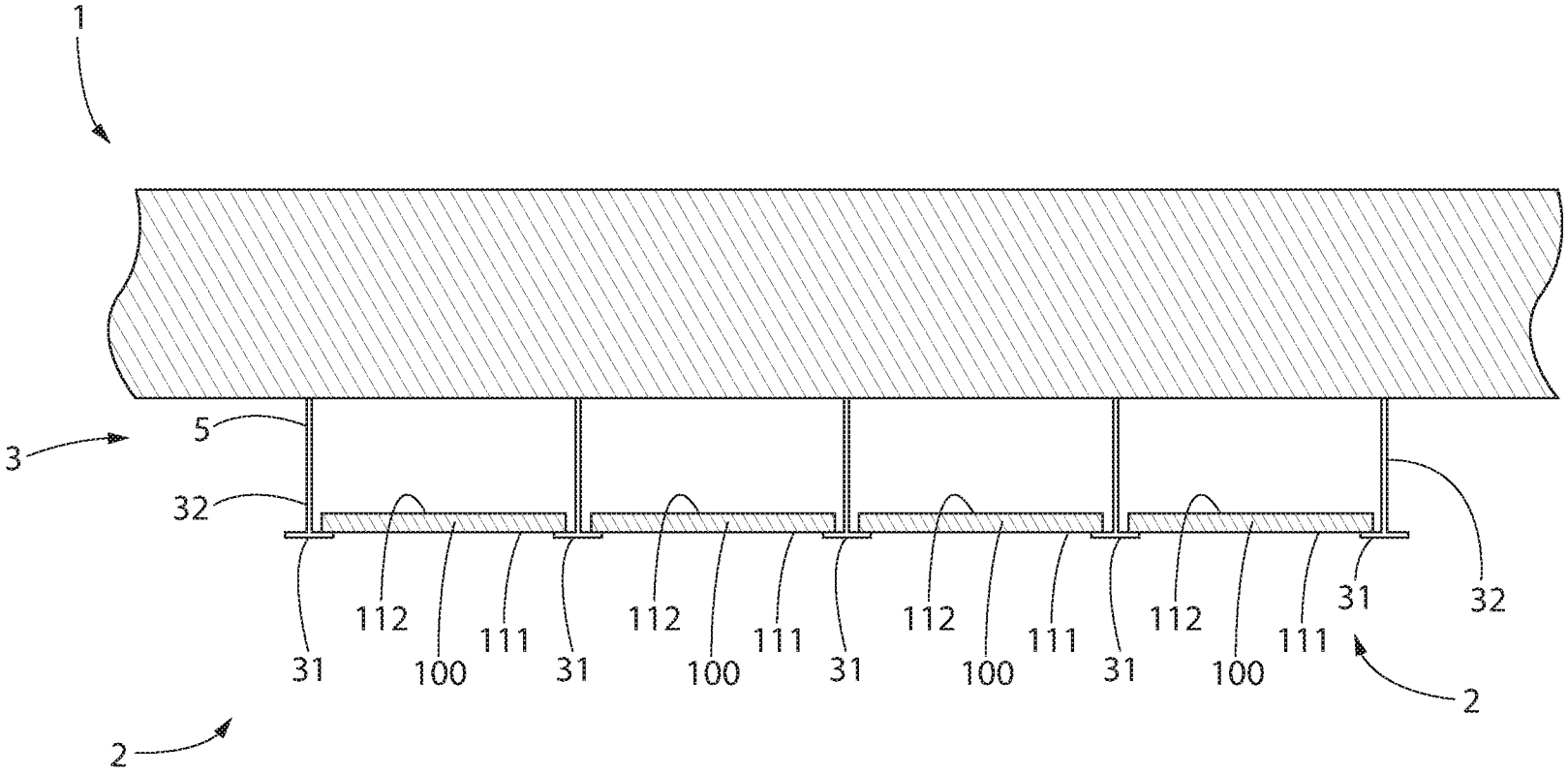
FIG. 3 is a ceiling system comprising the building panel of the present invention.

Referring to FIG. 3, the present invention may further include a ceiling system 1 comprising one or more of the building panels 100 installed in an interior space, whereby the interior space comprises a plenary space 3 and an active room environment 2. The plenary space 3 provides space for mechanical lines within a building (e.g., HVAC, plumbing, etc.). The active space 2 provides room for the building occupants during normal intended use of the building (e.g., in an office building, the active space would be occupied by offices containing computers, lamps, etc.).

In the installed state, the building panels 100 may be supported in the interior space by one or more parallel support struts 5. Each of the support struts 5 may comprise an inverted T-bar having a horizontal flange 31 and a vertical web 32. The ceiling system 1 may further comprise a plurality of first struts that are substantially parallel to each other and a plurality of second struts that are substantially perpendicular to the first struts (not pictured). In some embodiments, the plurality of second struts intersects the plurality of first struts to create an intersecting ceiling support grid. The plenary space 3 exists above the ceiling support grid and the active room environment 2 exists below the ceiling support grid. In the installed state, the first major surface 111 of the building panel 100 faces the active room environment 2 and the second major surface 112 of the building panel 100 faces the plenary space 3.

Figure 2:
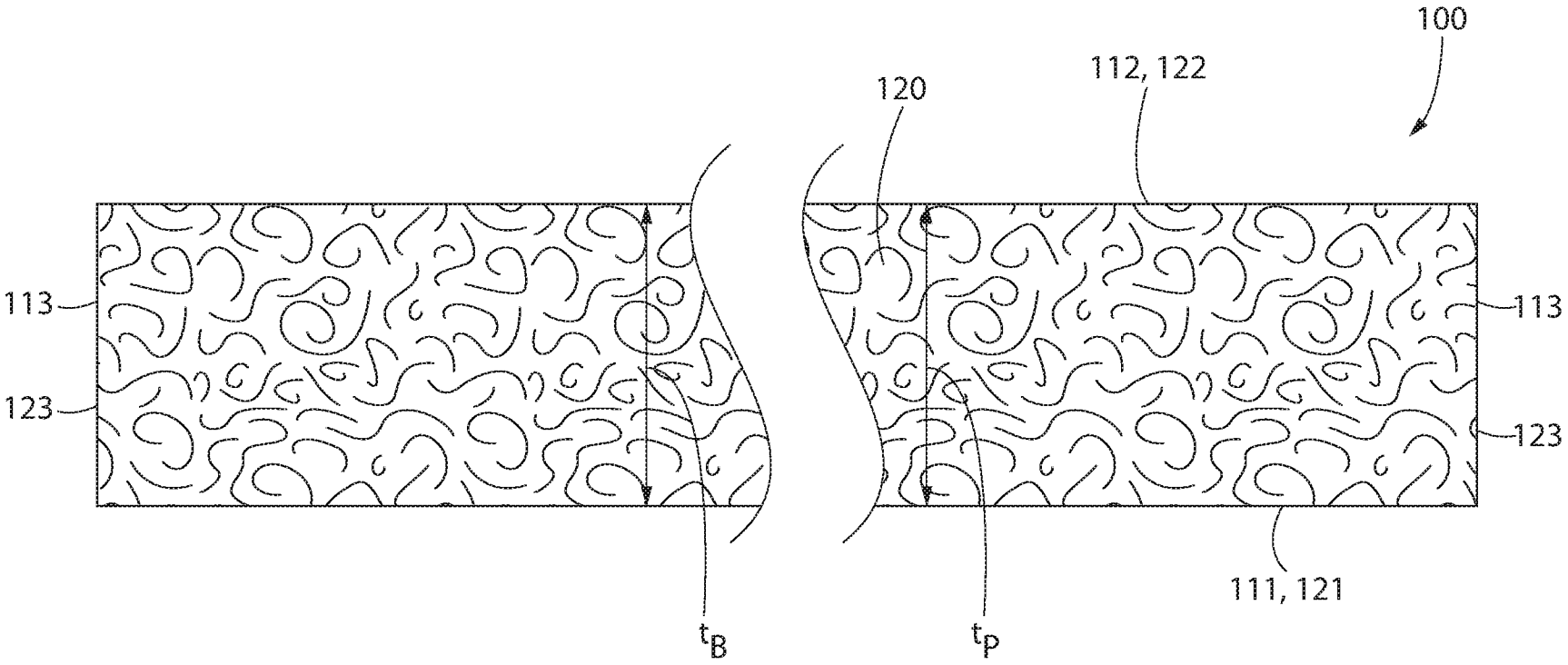
FIG. 2 is a cross-sectional view of the building panel according to the present invention, the cross-sectional view being along the II line set forth in FIG. 1.

Referring now to FIGS. 1 and 2, the building panel 100 of the present invention may have a panel thickness $t_P$ as measured from the first major surface 111 to the second major surface 112. The panel thickness $t_P$ may range from about 4.0 mm to about 25.0 mm—including all values and sub-ranges there-between. In a preferred embodiment, the panel thickness $t_P$ may range from about 4.0 mm to about 12 mm—including all values and sub-ranges there-between. In a preferred embodiment, the panel thickness $t_P$ may range from about 5.0 mm to about 6.0 mm—including all values and sub-ranges there-between.

The side surface 113 of the building panel 100 may comprise a first side surface 113*a*, a second side surface 113*b*, a third side surface 113*c*, and a fourth side surface 113*d*. The first side surface 113*a* may be opposite the second side surface 113*b*. The third side surface 113*c* may be opposite the fourth side surface 113*d*. The first and second side surfaces 113*a*, 113*b* may be substantially parallel to each other. The third and fourth side surfaces 113*c*, 113*d* may be substantially parallel to each other. The first and second side surfaces 113*a*, 113*b* may each intersect the third and fourth side surfaces 113*c*, 113*d* to form the perimeter of the ceiling panel 100.

The building panel 100 may have a panel length $L_P$ as measured between the third and fourth side surfaces 113*c*, 113*d* (along at least one of the first and second side surfaces 113*a*, 113*b*). The panel length $L_P$ may range from about 25.0 cm to about 300.0 cm—including all values and sub-ranges there-between. The building panel 100 may have a panel width $W_P$ as between the first and second side surfaces 113*a*, 113*b* (and along at least one of the third and fourth side surfaces 113*c*, 113*d*). The panel width $W_P$ may range from about 25.0 cm to about 125.0 cm—including all values and sub-ranges there-between. The panel length $L_P$ may be the same or different than the panel width $W_P$.

The building panel 100 may comprise a body 120 having an upper surface 122 opposite a lower surface 121 and a body side surface 123 that extends between the upper surface 122 and the lower surface 121, thereby defining a perimeter of the body 120. The body 120 may have a body thickness $t_B$ that extends from the upper surface 122 to the lower surface 121. The body thickness $t_B$ may substantially equal to the panel thickness $t_P$.

The first major surface 111 of the building panel 100 may comprise the lower surface 121 of the body 120. The second major surface 112 of the building panel 100 may comprise the upper surface 122 of the body 120. When the first major surface 111 of the building panel 100 comprises the lower surface 121 of the body 120 and the second major surface 112 of the building panel 100 comprises the upper surface 122 of the body 120, the panel thickness $t_P$ is substantially equal to the body thickness $t_B$.

The body side surface 123 may comprise a first body side surface 123*a*, a second body side surface 123*b*, a third body side surface 123*c*, and a fourth body side surface 123*d*. The first body side surface 123*a* may be opposite the second body side surface 123*b*. The third body side surface 123*c* may be opposite the fourth body side surface 123*d*. The first side surface 113*a* of the building panel 100 may comprise the first body side surface 123*a* of the body 120. The second side surface 113*b* of the building panel 100 may comprise the second body side surface 123*b* of the body 120. The third side surface 113*c* of the building panel 100 may comprise the third body side surface 123*c* of the body 120. The fourth side surface 113*d* of the building panel 100 may comprise the fourth body side surface 123*d* of the body 120.

The first and second body side surfaces 123*a*, 123*b* may each intersect the third and fourth body side surfaces 123*c*, 123*d* to form the perimeter of the body 120. The body 120 may have a width that is substantially equal to the panel width $W_P$—as measured between the first and second body side surfaces 123*a*, 123*b*. The body 120 may have a len45gth that is substantially equal to the panel length $L_P$—as measured between the third and fourth body side surfaces 123*c*, 123*d*.

In some embodiments, a coating may be applied to the lower surface 121, first body side surface 123*a*, second body side surface 123*b*, third body side surface 123*c*, and/or fourth body side surface 123*d* of the body 120 (not pictured). The coating may be continuous or discontinuous. The coating may comprise pigment. In some embodiments, the building panel 100 may further comprise a non-woven scrim may be applied to the lower surface 121 of the body 120 (not pictured).

The body 120 may be porous, thereby allowing airflow through the body 120 between the upper surface 122 and the lower surface 121—as discussed further herein. The body 120 may be formed from a blend of building components that include a fiber, a latex binder, and a filler. The body 120 has a density as measured by at least one of (1) skeletal density or (2) bulk density.

Skeletal density refers to the combined densities of the building components present in the body (e.g., fiber, filler, latex) while accounting for (i.e., removing) the volume within the body that is not occupied by the building components (i.e., voids) created by the porous nature of the body 120. The body 120 may have a skeletal density ranging from about 1.5 g/cm$^3$ to about 4.5 g/cm$^3$—including all densities and sub-ranges there-between. According to some embodiments, the body 120 may have a skeletal density ranging from about 2.1 g/cm$^3$ to about 3.1 g/cm$^3$—including all densities and sub-ranges there-between.

The bulk density of the body 120 is based on an overall volume of the body 120 as measured between the upper surface 121, the lower surface 122, and the body side surfaces 123. The bulk density includes the volume occupied within the body 120 that is created by the voids between building components. The body 120 may have a bulk density ranging from about 0.15 g/cm$^3$ to about 0.25 g/cm$^3$—including all densities and sub-ranges there-between. According to some embodiments, the body 120 may have a skeletal density ranging from about 0.17 g/cm$^3$ to about 0.2 g/cm$^3$—including all densities and sub-ranges there-between.

The difference between the skeletal density and the bulk density demonstrates the high porosity of the body 120 according to the present invention. The ratio of skeletal density to bulk density may range from about 10:1 to about 30:1—including all ratios and sub-ranges there-between.

The fibers may be organic fibers, inorganic fibers, or a blend thereof. Non-limiting examples of inorganic fibers mineral wool (also referred to as slag wool), rock wool, stone wool, and glass fibers. Non-limiting examples of organic fiber include fiberglass, cellulosic fibers (e.g. paper fiber—such as newspaper, hemp fiber, jute fiber, flax fiber, wood fiber, or other natural fibers), polymer fibers (including polyester, polyethylene, aramid—i.e., aromatic polyamide, and/or polypropylene), protein fibers (e.g., sheep wool), and combinations thereof.

The fibers may have an average diameter ranging from about 3 microns to about 10 microns—including all sizes and sub-ranges there-between. In a preferred embodiment, the fibers may have an average diameter ranging from about 4 microns to about 8 microns—including all sizes and sub-ranges there-between. The aforementioned ratios and sub-ranges include ratios to the tenth decimal point between integer values—such as 4.8 microns, 6.5 microns, and so forth.

The fiber may be present in an amount ranging from about 35 wt. % to about 95 wt. % based on the total weight of the body 120—including all amounts and sub-ranges there-between. In other embodiments the fiber may be present in an amount ranging from about 70 wt. % to about 95 wt. % based on the total weight of the body 120—including all amounts and sub-ranges there-between. In other embodiments, the fiber may be present in an amount ranging from about 75 wt. % to about 99 wt. % based on the total weight of the body 120—including all amounts and sub-ranges there-between.

The latex binder may comprise a polymer. The polymer may have at least one functional group that has an ionic charge or is capable of creating an ionic charge. The ionic charge may be anionic or cationic. The polymer may comprise functional groups that are both anionic and cationic, however, that polymer will exhibit a greater amount of either the anionic or cationic groups resulting in the polymer being either cationic or anionic overall.

The polymer used in the latex binder may be formed from the polymerization product of one or more unsaturated monomers. Non-limiting examples of unsaturated monomers include an ethylenically unsaturated carboxylic acid monomer, nonionic vinyl monomers, and ethylenically unsaturated amine containing compounds, and combinations thereof.

The unsaturated carboxylic acid monomer may include $C_3$-$C_8$ α, β-ethylenically unsaturated carboxylic acid monomer having the general formula:

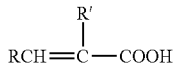

where R is H, —COOX, or $CH_3$;

R is H, $C_1$-$C_4$ alkyl, or —$CH_2$—COOX; and

X is H or $C_1$-$C_4$ alkyl.

Non-limiting examples of the unsaturated carboxylic acid monomer may include acrylic acid; methacrylic acid; a mixture of acrylic acid and methacrylic acid; itaconic acid; fumaric acid; crotonic acid; aconitic acid, maleic acid, various α-substituted acrylic acids such as α-ethacrylic acid, α-propyl acrylic acid and α-butyl acrylic acid, and half esters of these polycarboxylic acids and mixtures of these polycarboxylic acids.

The carboxylic acid group present in the polymer backbone of the latex binder may form a carboxylate ion, $COO^-$, which is capable for forming an ion having a negative charge (i.e., anionic charge). Thus, the amount of carboxylic acid groups present on the polymer backbone will impact the resulting ionic charge of the latex binder. Polymers formed from greater relative amounts of the unsaturated carboxylic acid monomer will increase the anionic nature of the resulting latex binder.

The nonionic vinyl monomer may include a $C_2$-$C_{12}$ α,β-ethylenically unsaturated vinyl monomer. The $C_2$-$C_{12}$ α,β-ethylenically unsaturated vinyl monomer having the general formula:

$$CH_2{=}CYZ$$

where Y is H, $CH_3$, or Cl;

Z is —COOX', CH=$CH_2$, —$C_6H_4$—R", CN, or Cl;

X' is $C_1$-$C_8$ alkyl or $C_2$-$C_8$ hydroxyalkyl;

R" is H, Cl, Br, or $C_1$-$C_4$ alkyl.

Non-limiting examples of the nonionic vinyl monomer include $C_1$-$C_8$ alkyl and $C_2$-$C_8$ hydroxyalkyl esters of acrylic and methacrylic acid, such as ethyl acrylate, ethyl methacrylate, methyl methacrylate, 2-ethylhexyl acrylate, butyl acrylate, butyl, methacrylate, 2-hydroxyethyl acrylate. 2-hydroxybutyl methacrylate; styrene, vinyltoluene, t-butylstyrene, isopropylstyrene, and p-chlorostyrene; vinyl acetate, vinyl butyrate, vinyl caprolate; acrylonitrile, methacrylonitrile, butadiene, isoprene, vinyl chloride vinylidene chloride, and the like. Additionally, a monovinyl ester such as ethyl acrylate or a mixture thereof with styrene, hydroxyethyl acrylate, acrylonitrile, vinyl chloride or vinyl acetate may be preferred. The nonionic vinyl monomer described hereinabove can be a mixture of co-monomers.

The ethylenically unsaturated amine containing compounds may be compounds having one or two unsaturated groups, as well as an amine group. Non-limiting examples of the ethylenically unsaturated amine containing compound include N-allylmethacrylamide.

The amine group present in the polymer backbone of the latex binder may form a positively charged ion, $N^+$, (i.e., cationic charge). Thus, the amount of ethylenically unsaturated amine containing compound present on the polymer backbone will impact the resulting ionic charge of the latex binder. Polymers formed from greater relative amounts of the ethylenically unsaturated amine containing compound will increase the cationic nature of the resulting latex binder.

The polymer forming the latex binder may have a glass transition temperature ranging from about 50° C. to about 120° C.—including all temperatures and sub-ranges there-between. In a preferred embodiment, the polymer forming the latex binder may have a glass transition temperature ranging from about 70° C. to about 110° C.—including all temperatures and sub-ranges there-between. The polymer forming the latex binder may have a glass transition temperature of at least 90° C. ranging up to about 110° C.—including all temperatures and sub-ranges there-between.

The latex binder may be present relative to the fibers and the latex binder in a weight ratio ranging from about 1:9 to about 1:33—including all ratios and sub-ranges there-between. The latex binder may be present in an amount ranging from a non-zero amount up to about 15 wt. % based on the total dry weight of the body 120—including all values and sub-ranges there-between. In a preferred embodiment, the latex binder may be present in an amount ranging from about 1 wt. %, up to about 15 wt. % based on the total dry weight of the body 120—including all values and sub-ranges there-between. In a preferred embodiment, the latex binder may be present in an amount ranging from about non-zero amount, preferably at least 3 wt. %, up to about 10 wt. % based on the total dry weight of the body 120—including all values and sub-ranges there-between. The latex binder may be present in an amount ranging from about 3 wt. % to about 8 wt. % based on the total dry weight of the body 120—including all value and sub-ranges there-between. The latex binder may be present in an amount ranging from about 4 wt. % to about 7 wt. % based on the total dry weight of the body 120—including all value and sub-ranges there-between.

The phrase "dry-weight" refers to the weight of a referenced component without the weight of any carrier. Thus, when calculating the weight percentages of components in the dry-state, the calculation should be based solely on the solid components (e.g., latex binder, fiber, filler, additives, etc.) and should exclude any amount of residual carrier (e.g., water, VOC solvent) that may still be present from a wet-state, which will be discussed further herein. According to the present invention, the phrase "dry-state" may also be used to indicate a component that is substantially free of a carrier, as compared to the term "wet-state," which refers to that component still containing various amounts of carrier—as discussed further herein.

The filler may be organic filler, inorganic filler, or a blend thereof. Non-limiting examples of inorganic filler may include powders of calcium carbonate, limestone, titanium dioxide, sand, barium sulfate, clay (also referred to as kaolin), mica, dolomite, silica, talc, perlite, gypsum, wollastonite, expanded-perlite, calcite, aluminum trihydrate, pigments, zinc oxide, or zinc sulfate.

The filler may be present in the body 120 of the building panel 100 in an amount ranging from about 1 wt. % to about 60 wt. %—including all amounts and sub-ranges there-between—based on the total weight of the body 120. The filler may have a particle size ranging from about 1.0 micron to about 1000.0 microns—including all sizes and sub-ranges there-between.

According to the present invention, the filler may specifically comprise an extender filler—which includes an inorganic powder. Non-limiting examples of inorganic powder suitable as the extender filler include at least one of calcium carbonate, kaolin, or a combination thereof. As described herein, the extender filler imparts to the body 120 superior strength while simultaneously maintaining the desired sag-resistance.

The extender filler may be present in an amount ranging from about 3 wt. % to about 30 wt. % based on the total dry weight of the body 120—including all values and sub-ranges there-between. In a preferred embodiment, the extender filler may be present in an amount ranging from about 6 wt. % to about 25 wt. % based on the total dry weight of the body 120—including all values and sub-ranges there-between.

According to the present invention, the extender filler may be present in the body 120 relative to the latex binder. Specifically, the extender filler may be present relative to the latex binder in a weight ratio ranging from about 1:1 to about 6:1—including all ratios and sub-ranges there-between. The aforementioned ratios and sub-ranges include ratios to the tenth decimal point between integer values—such as 2.5:1, 2.7:1, 1.7:1, and so forth. The weight ratio of the extender filler to the latex binder may range from about 2:1 to about 6:1—including all ratios and sub-ranges there-between. Some embodiments provide that the weight ratio of the extender filler to the latex binder may range from about 2.5:1 to about 5.5:1—including all ratios and sub-ranges there-between. Other embodiments provide that, the weight ratio of the extender filler to the latex binder may range from about 1:1 to about 3.5:1. In a preferred embodiment, the weight ratio of the extender filler to the latex binder may range from about 2.5:1 to about 4.5:1—including all ratios and sub-ranges there-between. The weight ratio of the extender filler to the latex binder may be about 3:1.

The extender filler may have an average particle size ranging from about 1 micron to about 15 microns—including all sizes and sub-ranges there-between. The aforementioned ratios and sub-ranges include ratios to the tenth decimal point between integer values—such as, for example, 4.5 microns, 3.7 microns, 5.4 microns, and so forth. The extender filler may have an average particle size ranging from about 1 micron to about 13 microns—including all sizes and sub-ranges there-between. In a preferred embodiment, the extender filler may have an average particle size ranging from about 3 microns to about 8 microns—including all sizes and sub-ranges there-between.

The extender filler may have a particle size distribution such that 100 wt. % of the filler has a particle size less than about 80 microns. Specifically, for the extender filler having an average particle size ranging between Specifically, for the extender filler having an average particle size ranging between 8 microns and 13 microns, the extender filler may have a particle size distribution such that 100 wt. % of the extender filler has a particle size less than 80 micron and more than 20 wt. % has a particle size greater than 6 microns. For the extender filler having an average particle size ranging between 4.5 microns and 7.5 microns, the extender filler may have a particle size distribution such that 100 wt. % of the extender filler has a particle size less than 30 micron and more than 10 wt. % has a particle size greater than 1 micron. For the extender filler having an average particle size ranging between about 1 micron and 3.5 microns, the extender filler may have a particle size distribution such that 100 wt. % of the extender filler has a particle size less than 7 microns and more than 25 wt. % has a particle size greater than 0.5 microns.

Adding the extender filler of the present invention to the body 120 allows for a corresponding decrease in the total amount of fiber and latex binder needed to for the body 120. Additionally, it has been discovered that the addition of the extender filler does not substantially interfere with the airflow properties of the body 120—as discussed further herein. Moreover, it has also been surprisingly discovered that the body 120 formed from the fiber, latex binder, and extender filler of the present invention exhibits superior rigidity resulting in superior sag-resistance—as compared to building panels comprising a body not including the extender filler of the present invention. Therefore, the combination of desirable airflow, strength, and reduced amounts of fiber and latex binder result in body 120 that is not only particularly suitable for building panels 100 to be used as acoustically pervious ceiling panels with enhanced sag-resistance, but also reduces cost concerns because such bodies 120 can be produced using relative less fiber and latex binder.

The body 120 may further comprise additives—such as defoamers, wetting agents, charge-modifying agents, biocides, flocculants, dispersing agents, flame retardants, and the like. The additive may be present in an amount ranging from about 0.01 wt. % to about 30 wt. % based on the total dry weight of the body 120—including all values and sub-ranges there-between. Non-limiting examples of flocculants include ionic flocculants, such as cationic polyacrylamide.

The body 120 may further comprise a charge-modifying component. The charge-modifying component may be ionic—having either a cationic or anionic charge. Non-limiting examples of cationic charge-modifying component includes aluminum sulfate, poly(diallyldimethylammonium chloride), and combinations thereof. The charge-modifying component may be present in an amount ranging from about 0.1 wt. % to about 4.0 wt. % based on the total dry-weight of the body 120—including all values and sub-ranges there-between.

The charge-modifying component may also be present in an amount defined relative to the latex binder. Specifically, the charge-modifying component may be present in an amount that ranges from about 20 wt. % to about 70 wt. % based on the total weight of the latex binder in the body 120—including all amounts and sub-ranges there-between. In a preferred embodiment, the charge-modifying component may be present in an amount that ranges from about 30 wt. % to about 60 wt. % based on the total weight of the latex binder—including all amounts and sub-ranges there-between. In some embodiments, the charge-modifying component may be present in an amount of about 30 wt. % based on the total weight of the latex binder. In some embodiments, the charge-modifying component may be present in an amount of about 60 wt. % based on the total weight of the latex binder.

The body 120 of the present invention may be formed according to a multi-step process. In a first step the fiber and carrier (preferably water) may be combined to form a first mixture. The water may be present in the first mixture in an amount ranging from about 90 wt. % to about 99.5 wt. %—based on the total weight of the first mixture and including all amounts and sub-ranges there-between.

The first mixture may be mixed with an agitator at room temperature or at an elevated temperature ranging from about 22° C. to about 80° C.—including all temperatures and sub-ranges there-between. The first mixture may be agitated for a period of time ranging between 10 seconds and 300 seconds—including each time and sub-range there-between. The first mixture may have a first pH value ranging from about 4 to about 9—including all sub-ranges and pH values there-between.

Subsequently, the filler—including the extender filler—may be added to the first mixture to form a second mixture. The second mixture may be mixed with an agitator at room temperature or at an elevated temperature ranging from about 22° C. to about 80° C.—including all temperatures and sub-ranges there-between. The second mixture may be agitated for a period of time ranging between 10 seconds and 300 seconds—including each time and sub-range there-between. The second mixture may have a second pH value ranging from about 6 to about 9—including all sub-ranges and pH values there-between. The first pH value may be the same or different than the second pH value. The addition of the calcium carbonate as the extender filler may help keep the pH of the mixture at a substantially neutral pH—whereby a neutral pH is about 7.

Next, the charge modifying component may be added to the second mixture to form a third mixture. The third mixture may be mixed with an agitator at room temperature or at an elevated temperature ranging from about 22° C. to about 80° C.—including all temperatures and sub-ranges there-between. The third mixture may be agitated for a period of time ranging between 10 seconds and 300 seconds—including each time and sub-range there-between. The third mixture may have a third pH value ranging from about 6 to about 9—including all sub-ranges and pH values there-between. The third pH value may be different than the second pH value and/or the third pH value.

Next, the latex binder may be added to the third mixture to form a fourth mixture. The fourth mixture may be mixed with an agitator at room temperature or at an elevated temperature ranging from about 22° C. to about 80° C.—including all temperatures and sub-ranges there-between. The fourth mixture may be agitated for a period of time ranging between 10 seconds and 300 seconds—including each time and sub-range there-between. The fourth mixture may have a fourth pH value ranging from about 6 to about 9—including all sub-ranges and pH values there-between. The fourth pH value may be the same or different than the third pH value. The fourth pH value may be different than the second pH value and/or first pH value.

Subsequently, the flocculants may be added to the fourth mixture to form a fifth mixture, whereby the fifth mixture may then be further processed into the body 120 of the present invention by a standard wet-laid process. The body 120 in the wet-state may be heated at an elevated temperature ranging from about 60° C. to about 300° C.—including all values and sub-ranges there-between—to dry the body 120 from the wet-state to the dry-state.

According to the present invention, the addition of the extender filler may result in a pH stabilization of the first, second, third, fourth, and fifth mixtures. Specifically, the addition of the extender filler to the first mixture and prior to the addition of the charge-modifying component may prevent the pH of any subsequent mixtures of becoming overly acidic—i.e., the maximum change in pH is two (2). Stated otherwise, according to the present invention, the maximum difference between the first pH value and the second pH value is less than 2. In some embodiments, the difference between the first pH value and the second pH value is less than 1. Additionally, the difference between the first pH value and the third pH value may be less than 2. In some embodiments, the difference between the first pH value and the third pH value may be less than 1.

The body 120 of the present invention may have a porosity ranging from about 60% to about 98%—including all values and sub-ranges there between. In a preferred embodiment, the body 120 has a porosity ranging from about 75% to 95%—including all values and sub-ranges there between. In a preferred embodiment, the body 120 has a porosity ranging from about 85% to 95%—including all values and sub-ranges there between.

According to the present invention, porosity refers to the following:

$$\%\ \text{Porosity}=[V_{Total}-(V_{Binder}+V_{Fiber}+V_{CMC}+V_{Filler})]/V_{Total}$$

Where $V_{Total}$ refers to the total volume of the body 120 defined by the upper surface 122, the lower surface 121, and the body side surfaces 123. $V_{Binder}$ refers to the total volume occupied by the latex binder in the body 120. $V_{Fiber}$ refers to the total volume occupied by the fibers 130 in the body 120. $V_{Filler}$ refers to the total volume occupied by the filler in the body 120. $V_{CMC}$ refers to the total volume occupied by the charge-modifying component in the body 120. Thus, the % porosity represents the amount of free volume within the body 120.

The body 120 may have an air flow resistance that is measured through the body 120 between the upper and lower surfaces 121, 122. Air flow resistance is a measured by the following formula:

$$R=(P_A-P_{ATM})/\dot{V}$$

Where R is air flow resistance (measured in ohms); $P_A$ is the applied air pressure; $P_{ATM}$ is atmospheric air pressure; and V is volumetric airflow. The air flow resistance of the body 120 may range from about 0.5 ohm to about 10 ohms—including all resistances and sub-ranges there-between. In a preferred embodiment, the airflow resistance of the body 120 may range from about 0.5 ohms to about 8 ohms—including all resistances and sub-ranges there-between. Airflow resistance, as measured in ohms, allows for lateral flow of air through the body. Therefore, when measuring ohms, not only is air flowing between the upper and lower surfaces 121, 122 of the body 120, but also the side surfaces 123 of the body 120.

According to the present invention, the addition of the extender filler allows for a relative reduction of latex binder in the building panel while still being able to achieve the same mechanical strength and sag resistance as a building panel having greater amounts of latex binder but no extender filler. The result allows for the production of a body 120 have sufficient mechanical strength that may be produced at cheaper material costs.

Additionally, it has been surprisingly discovered that the addition of the extender filler in combination with the latex creates a body 120 that is less porous but does not have the corresponding increase in airflow resistance. Previously, increasing porosity of a body 120 was a factor in improving airflow through a building panel—i.e., decreasing porosity of a body was expected to increase airflow resistance of that body. However, according to the present invention, the addition of the extender filler—calcium carbonate, in particular—allows for the porosity of the building panel to decrease without having an increase in airflow resistance R. The surprising combination of high airflow through the less porous body 120 results in a building panel having superior acoustical performance while being less susceptible to sag over time.

Alternatively, the air flow resistance of the body 120 may be measured in terms of MKS Rayls and range from about 50 MKS Rayls to about 200 MKS Rayls—including all resistances and sub-ranges there-between. In a preferred embodiment, the airflow resistance of the body 120 may range from about 60 MKS Rayls to about 150 MKS Rayls—including all resistances and sub-ranges there-between. Airflow resistance, as measured in MKS Rayls, does not allow for lateral flow of air through the body. Therefore, when measuring MKS Rayls, air is only flowing between the first and second major surfaces 121, 122 of the body 120, and not the side surfaces 123 of the body 120.

The body 120 of the present invention may be porous enough to exhibit sufficient airflow for the resulting building panel 100 to have the ability to reduce the amount of reflected sound in a room. The reduction in amount of reflected sound in a room is expressed by a Noise Reduction Coefficient (NRC) rating as described in American Society for Testing and Materials (ASTM) test method C423. This rating is the average of sound absorption coefficients at four ⅓ octave bands (250, 500, 1000, and 2000 Hz), where, for example, a system having an NRC of 0.90 has about 90% of the absorbing ability of an ideal absorber. A higher NRC value indicates that the material provides better sound absorption and reduced sound reflection.

The building panel 100 of the present invention exhibits an NRC of at least about 0.5. In a preferred embodiment, the building panel 100 of the present invention may have an NRC ranging from about 0.60 to about 0.99—including all value and sub-ranges there-between.

In addition to reducing the amount of reflected sound in a single room environment, the building panel 100 of the present invention should also be able to exhibit superior sound attenuation—which is a measure of the sound reduction between an active room environment 2 and a plenary space 3. The ASTM has developed test method E1414 to standardize the measurement of airborne sound attenuation between room environments 3 sharing a common plenary space 3. The rating derived from this measurement standard is known as the Ceiling Attenuation Class (CAC). Ceiling materials and systems having higher CAC values have a greater ability to reduce sound transmission through the plenary space 3—i.e. sound attenuation function. The building panels 100 of the present invention may exhibit a CAC value of 30 or greater, preferably 35 or greater.

In addition to reducing the amount of reflected sound in a single room environment, the building panel 100 of the present invention should also be able to exhibit superior sound attenuation—which is a measure of the sound reduction between an active room environment 2 and a plenary space 3. The ASTM has developed test method E1414 to standardize the measurement of airborne sound attenuation between room environments 3 sharing a common plenary space 3. The rating derived from this measurement standard is known as the Ceiling Attenuation Class (CAC). Ceiling materials and systems having higher CAC values have a greater ability to reduce sound transmission through the plenary space 3—i.e. sound attenuation function. The building panels 100 of the present invention may exhibit a CAC value of 30 or greater, preferably 35 or greater.

The following examples are prepared in accordance with the present invention. The present invention is not limited to the examples described herein.

EXAMPLES

Experiment 1 (Filler-Latex Impact Generally)

The first experiment was prepared to demonstrate the unexpected improvement in strength and acoustical performance of the body of the present invention. For this experiment, multiple bodies were prepared, each of which comprise mineral wool and latex binder. The overall amount of inorganic fiber (i.e., mineral wool) and latex binder were held constant. The latex binder comprising copolymer poly (styrene-acrylate) having a glass transition temperature T(g) of about 100° C. The bodies of examples 1-3 further comprise calcium carbonate filler and the bodies of examples 4-6 further comprise kaolin filler. The calcium carbonate filler has an average particle size of about 5.5 microns. The kaolin filler has an average particle size of about 4.5 microns. The mineral wool comprises fibers having an average diameter of about 6.4 microns. The body further comprised hydrated potassium aluminum sulfate in an amount constant for examples 1-6 and comparative examples 1-2. Comparative examples 1 and 2 include no filler. The formulation of each example is provided in Table 1.

TABLE 1

| | Ex. 1 | Ex. 2 | Ex. 3 | Ex. 4 | Ex. 5 | Ex. 6 | Comp. Ex. 1 | Comp. Ex. 2 |
|---|---|---|---|---|---|---|---|---|
| Mineral Wool (g) | 980.4 | 980.4 | 980.4 | 980.4 | 980.4 | 980.4 | 980.4 | 980.4 |
| Latex (g) | 51.6 | 51.6 | 51.6 | 51.6 | 51.6 | 51.6 | 51.6 | 72.2 |
| $CaCO_3$ (g) | 51.6 | 154.8 | 258 | — | — | — | — | — |
| Kaolin (g) | — | — | — | 51.6 | 154.8 | 258 | — | — |
| Filler:Latex Ratio | 1:1 | 3:1 | 5:1 | 1:1 | 3:1 | 5:1 | — | — |
| Porosity | 92.9% | 92.4% | 91.7% | 93.2% | 92.1% | 91.0% | 93.4% | 93.2% |
| Skeletal Density (g/cm$^3$) | 2.52 | 2.55 | 2.57 | 2.55 | 2.55 | 2.57 | 2.53 | 2.48 |
| Bulk Density (g/cm$^3$) | 0.18 | 0.19 | 0.21 | 0.17 | 0.20 | 0.23 | 0.16 | 0.17 |
| Air Flow Resistance (Ohms) | 2.9 | 2.6 | 3.0 | 2.6 | 3.3 | 3.9 | 2.6 | 2.2 |
| Air Flow Resistance (Rayls) | 88 | N/A | 98 | 77 | N/A | 131 | 71 | 67 |
| Break Strength (Rupture Modulus - psi) | 48.7 | 61.0 | 59.0 | 27.0 | 42.0 | 46.0 | 31.0 | 39.0 |
| Rigidity (Elastic Modulus - psi) | 7969 | 11813 | 11835 | 4343 | 8478 | 10680 | 4633 | 6363 |
| Indent at 30 lbs (inch) | 0.475 | 0.423 | 0.383 | 0.522 | 0.460 | 0.415 | 0.524 | 0.474 |

As demonstrated by Table 1, it has been surprisingly discovered that substituting a portion of the body with inorganic filler having an average particle size less than 10 micron, whereby the filler is present relative to the latex binder in a ratio ranging from about 1:1 up to about 5:1 provides a marked improvement in strength of the body without any substantial interference in the airflow properties require for the body to be used as an acoustical panel.

Additionally, it has also been surprisingly discovered that using calcium carbonate in particular in filler to latex binder weight ratio ranging between about 1:1 and 5:1 provides an even more significant jump in mechanical strength without substantial degradation in airflow performance as compared to bodies formed without such inorganic filler—whereby the ratio of calcium carbonate filler to latex binder ranging from about 2:1 to about 4:1 providing the most significant improvement in body strength while also maintained the desired airflow properties.

Experiment 2 (Particle Size)

Another set of experiments was prepared to demonstrate the impact of particle size of the filler in the body of the present invention. The overall amount of inorganic fiber (i.e., mineral wool) and latex binder were held constant. The latex binder comprising copolymer poly(styrene-acrylate) having a glass transition temperature T(g) of about 100° C. A first set of experiments were prepared using a weight ratio of inorganic filler (calcium carbonate) to latex binder that is about 1:1. The formulations and corresponding test results are shown in Table 2.

TABLE 2

| | Ex. 7 | Ex. 8 | Ex. 9 | Ex. 10 | Ex. 11 | Ex. 12 |
|---|---|---|---|---|---|---|
| Bench Cake | 9 | 7 | 4 | 1 | 5 | 10 |
| Average Filler Size (μm) | 1 | 1 | 5.5 | 5.5 | 13 | 13 |
| Alum % | 30 | 60 | 30 | 60 | 30 | 60 |
| Porosity | 92.7% | 92.7% | 93.0% | 93.2% | 91.7% | 93.4% |
| Skeletal Density (g/cm$^3$) | 2.37 | 2.42 | 2.5 | 2.54 | 2.41 | 2.54 |
| Air Flow Resistance (Rayls) | 63 | 61 | 67 | 61 | 66 | 58 |
| Young's Modulus | 115 | 107 | N/A | 145 | 93 | 95 |
| Indent at 30 lbs (inch) | 0.410 | 0.402 | 0.356 | 0.424 | 0.365 | 0.643 |

As demonstrated by Table 2, it has been surprisingly discovered that superior rigidity is achieved without substantial interference to airflow properties when using extender filler (calcium carbonate) having an average particle size between 1 micron and 13 microns as well as a weight ratio of extender filler to latex binder of about 1:1—with particularly superior performance at an average particle size of about 5 microns to about 6 microns.

The same experiment was repeated expect using inorganic filler (calcium carbonate) to latex binder that is about 3:1. The formulations and corresponding test results are shown in Table 3.

TABLE 3

| | Ex. 13 | Ex. 14 | Ex. 15 | Ex. 16 | Ex. 17 | Ex. 18 |
|---|---|---|---|---|---|---|
| Bench Cake | 12 | 8 | 6 | 3 | 11 | 2 |
| Average Filler Size (μm) | 1 | 1 | 5.5 | 5.5 | 13 | 13 |
| Alum % | 30 | 60 | 30 | 60 | 30 | 60 |
| Porosity | 92.3% | 93.4% | 92.6% | 92.4% | 92.5% | 92.4% |
| Skeletal Density (g/cm$^3$) | 2.54 | 2.52 | 2.51 | 2.55 | 2.54 | 2.54 |
| Air Flow Resistance (Rayls) | 65 | 77 | 67 | 72 | 63 | 66 |
| Young's Modulus | 121 | 121 | 198 | 117 | 132 | 199 |
| Indent at 30 lbs (inch) | 0.401 | 0.395 | 0.359 | 0.34 | 0.392 | 0.329 |

As demonstrated by Table 3, it has been surprisingly discovered that superior rigidity is achieved without substantial interference to airflow properties when using extender filler (calcium carbonate) having an average particle size between 1 micron and 13 microns as well as a weight ratio of extender filler to latex binder of about 3:1—with particularly superior performance at an average particle size of about 5 microns to about 6 microns.

The same experiment was repeated expect using inorganic filler (kaolin) to latex binder that is about 1:1. The formulations and corresponding test results are shown in Table 4.

TABLE 4

| | Ex. 19 | Ex. 20 | Ex. 21 | Ex. 22 |
|---|---|---|---|---|
| Bench Cake | 6 | 8 | 2 | 3 |
| Average Filler Size (μm) | 1 | 1 | 4.5 | 4.5 |
| Alum % | 30 | 60 | 30 | 60 |
| Thickness (inches) | 0.888 | 0.912 | 0.986 | 0.934 |
| Weight (g) | 34.1 | 36.3 | 34.6 | 35.3 |
| Bulk Density (g/cm$^3$) | 0.186 | 0.193 | 0.170 | 0.184 |
| Porosity | 92.4% | 92.2% | 93.1% | 92.5% |

TABLE 4-continued

| | Ex. 19 | Ex. 20 | Ex. 21 | Ex. 22 |
|---|---|---|---|---|
| Skeletal Density (g/cm$^3$) | 2.49 | 2.52 | 2.51 | 2.49 |
| Air Flow Resistance (Rayls) | 58 | 65 | 70 | 68 |
| Young's Modulus | 104 | 94 | 89 | 129 |
| Indent at 30 lbs (inch) | 0.429 | 0.375 | 0.507 | 0.452 |

As demonstrated by Table 4, it has been surprisingly discovered that superior rigidity is achieved without substantial interference to airflow properties when using extender filler (kaolin) having an average particle size between 1 micron and 5 microns as well as a weight ratio of extender filler to latex binder of about 1:1—with particularly superior performance at a particle size of about 4.5.

The same experiment was repeated expect using inorganic filler (kaolin) to latex binder that is about 3:1. The formulations and corresponding test results are shown in Table 4.

TABLE 5

| | Ex. 23 | Ex. 24 | Ex. 25 | Ex. 26 |
|---|---|---|---|---|
| Bench Cake | 7 | 5 | 1 | 4 |
| Average Filler Size (μm) | 1 | 1 | 4.5 | 4.5 |
| Alum % | 30 | 60 | 30 | 60 |
| Thickness (inches) | 0.883 | 0.937 | 0.942 | 0.982 |
| Weight (g) | 39.0 | 38.9 | 39.2 | 38.2 |
| Bulk Density (g/cm$^3$) | 0.215 | 0.202 | 0.202 | 0.189 |
| Porosity | 91.4% | 91.9% | 91.9% | 92.3% |
| Skeletal Density (g/cm$^3$) | 2.55 | 2.54 | 2.55 | 2.52 |
| Air Flow Resistance (Rayls) | 87 | 95 | 95 | 82 |
| Young's Modulus | 136 | 123 | 149 | 129 |
| Indent at 30 lbs (inch) | 0.428 | 0.423 | 0.409 | 0.398 |

As demonstrated by Table 5, it has been surprisingly discovered that superior rigidity is achieved without substantial interference to airflow properties when using extender filler (kaolin) having an average particle size between 1 micron and 5 microns as well as a weight ratio of extender filler to latex binder of about 3:1—with particularly superior performance at an average particle size of about 4.5.

The results set forth in Tables 2 and 3 for calcium carbonate filler are reorganized and summarized below in Table 6.

TABLE 6

| | Ex. 7 | Ex. 8 | Ex. 13 | Ex. 14 | Ex. 9 | Ex. 10 | Ex. 15 | Ex. 16 | Ex. 11 | Ex. 12 | Ex. 17 | Ex. 18 |
|---|---|---|---|---|---|---|---|---|---|---|---|---|
| Average Filler Size (μm) | 1 | 1 | 1 | 1 | 5.5 | 5.5 | 5.5 | 5.5 | 13 | 13 | 13 | 13 |
| Filler:Binder Ratio | 1:1 | 1:1 | 3:1 | 3:1 | 1:1 | 1:1 | 3:1 | 3:1 | 1:1 | 1:1 | 3:1 | 3:1 |
| Alum % | 30 | 60 | 30 | 60 | 30 | 60 | 30 | 60 | 30 | 60 | 30 | 60 |
| Thickness (inches) | 1.007 | 1.024 | 1.002 | 1.040 | 1.005 | 1.007 | 1.024 | 0.982 | 0.958 | 1.039 | 0.980 | 0.982 |
| Weight (g) | 35.3 | 34.8 | 39.5 | 34.9 | 35.6 | 35.1 | 38.2 | 38.2 | 38.7 | 34.9 | 37.4 | 38.2 |
| Bulk Density (g/cm$^3$) | 0.170 | 0.164 | 0.191 | 0.163 | 0.172 | 0.169 | 0.181 | 0.189 | 0.196 | 0.163 | 0.185 | 0.189 |
| Porosity | 92.7% | 92.7% | 92.3% | 93.4% | 93.0% | 93.2% | 92.6% | 92.4% | 91.7% | 93.4% | 92.5% | 92.4% |
| Skeletal Density (g/cm$^3$) | 2.37 | 2.42 | 2.54 | 2.52 | 2.5 | 2.54 | 2.51 | 2.55 | 2.41 | 2.54 | 2.54 | 2.54 |
| Air Flow Resistance (Rayls) | 63 | 61 | 65 | 77 | 67 | 61 | 67 | 72 | 66 | 58 | 63 | 66 |
| Young's Modulus | 115 | 107 | 121 | 121 | ??? | 145 | 198 | 117 | 93 | 95 | 132 | 199 |
| Indent at 30 lbs (inch) | 0.410 | 0.402 | 0.401 | 0.395 | 0.356 | 0.424 | 0.359 | 0.34 | 0.365 | 0.643 | 0.392 | 0.329 |

As demonstrated by Table 6, it has been surprisingly discovered that superior rigidity is achieved without substantial interference to airflow properties when using extender filler (calcium carbonate) having an average particle size between 4 microns to about 6 microns and a weight ratio of extender filler to latex binder of about 3:1.

The results set forth in Tables 4 and 5 are reorganized and summarized below in Table 7.

TABLE 7

| | Ex. 19 | Ex. 20 | Ex. 23 | Ex. 24 | Ex. 21 | Ex. 22 | Ex. 25 | Ex. 26 |
|---|---|---|---|---|---|---|---|---|
| Average Filler Size (μm) | 1 | 1 | 1 | 1 | 4.5 | 4.5 | 4.5 | 4.5 |
| Filler:Binder Ratio | 1:1 | 1:1 | 3:1 | 3:1 | 1:1 | 1:1 | 3:1 | 3:1 |
| Alum % | 30 | 60 | 30 | 60 | 30 | 60 | 30 | 60 |
| Thickness (inches) | 0.888 | 0.912 | 0.883 | 0.937 | 0.986 | 0.934 | 0.942 | 0.982 |
| Weight (g) | 34.1 | 36.3 | 39.0 | 38.9 | 34.6 | 35.3 | 39.2 | 38.2 |
| Bulk Density (g/cm$^3$) | 0.186 | 0.193 | 0.215 | 0.202 | 0.170 | 0.184 | 0.202 | 0.189 |
| Porosity | 92.4% | 92.2% | 91.4% | 91.9% | 93.1% | 92.5% | 91.9% | 92.3% |
| Skeletal Density (g/cm$^3$) | 2.49 | 2.52 | 2.55 | 2.54 | 2.51 | 2.49 | 2.55 | 2.52 |
| Air Flow Resistance (Rayls) | 58 | 65 | 87 | 95 | 70 | 68 | 95 | 82 |
| Young's Modulus | 104 | 94 | 136 | 123 | 89 | 129 | 149 | 129 |
| Indent at 30 lbs (inch) | 0.429 | 0.375 | 0.428 | 0.423 | 0.507 | 0.452 | 0.409 | 0.398 |

As demonstrated by Table 7, it has been surprisingly discovered that superior rigidity is achieved without substantial interference to airflow properties when using extender filler (kaolin) having an average particle size between 4 microns to about 6 microns and a weight ratio of extender filler to latex binder of about 3:1.

Experiment 3 (Sag Resistance)

Another set of experiments was prepared to demonstrate the sag resistance of each body according to the present invention. The bodies prepared in Experiment 1 were cut to size 3"×24" and suspended horizontally with the support being located only at each end—length-wise—of the body. Each body was placed in a controlled chamber for four (4) days whereby the environment was cycled between:

18 hours at 104° F. and 109% relative humidity ("RH"); and 6 hours of 82° F. and 50% RH The sag and deflection of each sample body was measured in 2-minute intervals. The results are provided in Table 8 below.

TABLE 8

| | Ex. 1 | Ex. 2 | Ex. 3 | Ex. 4 | Ex. 5 | Ex. 6 | Comp. Ex. 1 | Comp. Ex. 2 |
|---|---|---|---|---|---|---|---|---|
| Filler:Latex Binder Ratio | 1:1 | 3:1 | 5:1 | 1:1 | 3:1 | 5:1 | — | — |
| Median Filler Size (μm) | 5.5 | 5.5 | 5.5 | 5.5 | 5.5 | 5.5 | — | — |
| Cycle 1 - 18 hrs 104° F./109% RH Defl. (mils) | −16.7 | −16.9 | −15.2 | −14.0 | −17.2 | −28.1 | −19.5 | −19.2 |
| Cycle 1 - 6 hrs 82° F./50% RH Defl. (mils) | −19.0 | −19.6 | −18.2 | −16.1 | −19.9 | −33.6 | −24.2 | −20.8 |
| Cycle 2 - 18 hrs 104° F./109% RH Defl. (mils) | −25.7 | −26.0 | −23.5 | −21.9 | −24.6 | −42.1 | −30.3 | −27.3 |
| Cycle 2 - 6 hrs 82° F./50% RH Defl. (mils) | −22.6 | −23.2 | −21.7 | −19.5 | −23.2 | −39.6 | −28.6 | −24.7 |
| Cycle 3 - 18 hrs 104° F./109% RH Defl. (mils) | −27.7 | −28.2 | −25.5 | −24.0 | −26.3 | −45.7 | −33.2 | −29.6 |
| Cycle 3 - 6 hrs 82° F./50% RH Defl. (mils) | −24.0 | −24.9 | −23.1 | −20.8 | −24.5 | −41.9 | −30.0 | −26.1 |
| Cycle 4 - 18 hrs 104° F./109% RH Defl. (mils) | −32.2 | −32.4 | −29.2 | −27.2 | −29.5 | −50.3 | −36.9 | −34.8 |
| Cycle 4 - 6 hrs 82° F./50% RH Defl. (mils) | −26.5 | −27.4 | −25.4 | −23.2 | −26.5 | −45.4 | −32.3 | −29.2 |

Deflection is from level horizontal

As demonstrated by Table 8, the sag resistance observed in the unfilled latex control samples is not compromised with mineral fill except in the case of filler to latex binder ratio ranging from about 3:1 to about 5:1. It is clear that filling the latex with mineral particulates of correct particle size at correct ratios will significantly strengthen these highly porous webs without sacrificing resistance to temperature-humidity induced sag.

Experiment 4 (pH Control)

A final set of experiments were prepared that demonstrate how the body of the present invention provides an unexpected reduction in degradation to equipment during manufacture of the body. Specifically, the composition of the body provides a surprising stabilizing effect to the pH during manufacture of the body, thereby avoiding excessive acidic environments that would rapidly corrode and degrade manufacturing equipment over time.

As a control, a first set of bodies (comparative Examples 3 and 4) were prepared according to the following methodology. A first mixture was formed by mixing together inorganic fiber and water. The first mixture was stirred for 2 minutes, after which a first pH value was measured. Subsequently, aluminum sulfate (30% concentration) was added to the first mixture to form a second mixture. After stirring the second mixture for one minute, a second pH value was measured. Subsequently, latex binder was added to the second mixture to form a third mixture. After stirring the third mixture for one minute, a third pH value was measured.

According to the present invention, a second set of bodies (Examples 27 and 28) were prepared according to the following methodology. A first mixture was formed by mixing together inorganic fiber and water. The first mixture was stirred for 2 minutes, after which a first pH value was measured. Subsequently, inorganic filler (calcium carbonate) was added to the first mixture to form a modified first mixture. The first modified mixture was stirred for 1 minute and a first modified pH value was measured. Subsequently, aluminum sulfate (30% concentration) was added to the first modified mixture to form a second modified mixture. After stirring the second modified mixture for one minute, a second pH value was measured. Subsequently, latex binder was added to the second modified mixture to form a third modified mixture. After stirring the third modified mixture for one minute, a third pH value was measured.

The pH values of both the first set of bodies and the second set of bodies are set forth below in Table 9.

TABLE 9

| | Comp. Ex. 3 | Comp. Ex. 4 | Ex. 27 | Ex. 28 |
|---|---|---|---|---|
| First pH | 6.95 | 6.69 | 7.51 | 7.58 |
| First Modified pH | — | — | 7.9 | 7.92 |
| Second pH | 4.34 | 4.05 | 6.84 | 6.82 |
| Third pH | 4.03 | 5.43 | 6.84 | |
| Δ First pH & Second pH | 2.61 | 2.64 | 0.67 | 0.76 |
| Δ First pH & Third pH | 2.92 | 1.26 | 0.67 | — |

The addition of the inorganic particle during the manufacture of the body creates pH stabilization as evidenced by the smaller change in pH between the first pH value and the second pH values as well as the first pH value and the third pH values. Such pH stabilization prevents overly acidic environments as the various components are processed into the body that is used to form the building panel of the present invention. Thus, not only does the addition of the inorganic particles create a body that exhibits superior strength as well as desirable sag resistance and airflow properties, but it also surprisingly helps reduce the overall degradation of manufacturing equipment during formation of the body.

The same experiment was repeated except using a higher concentration of aluminum sulfate (60%)—the results are provided below in Table 10.

TABLE 10

| | Comp. Ex. 5 | Comp. Ex. 6 | Ex. 29 | Ex. 30 |
|---|---|---|---|---|
| First pH | 6.95 | 6.69 | 7.51 | 7.58 |
| First Modified pH | — | — | 7.9 | 7.92 |
| Second pH | 4.34 | 4.42 | 6.84 | 6.82 |
| Third pH | 4.85 | 5.43 | 6.84 | |
| Δ First pH & Second pH | 2.61 | 2.27 | 0.67 | 0.76 |
| Δ First pH & Third pH | 2.1 | 1.26 | 0.67 | — |

The data in Table 10 further confirm that the addition of the inorganic particles provides pH stabilization—even at elevated amounts of charge-modifying component.

What is claimed is:

1. A building panel comprising a body, the body comprising:

a fiber;

a latex binder present in an amount ranging from about 3 wt. % to about 10 wt. % based on the total weight of the body;

calcium carbonate particle having an average particle size ranging from about 4 microns to about 6 microns; and an ionic charge-modifying component present in an amount ranging from about 30 wt. % to about 60 wt. % based on the total weight of the latex binder;

wherein the ionic charge-modifying component comprises aluminum sulfate;

wherein the calcium carbonate particle and the latex binder are present in a weight ratio of 3:1; and wherein the body comprises a first major surface opposite a second major surface and a plurality of side surfaces extending between the first major surface and the second major surface, wherein the body has a porosity ranging from about 80% to about 98% as measured between the first major surface, the second major surface, and the plurality of side surfaces.

2. The building panel according to claim 1, wherein the average particle size of the inorganic particle ranges is about 5 microns.

3. The building panel according to claim 1, wherein the fiber is present in an amount ranging from about 65 wt. % to about 95 wt. % based on the total weight of the body.

4. The building panel according to claim 1, wherein the amount of latex binder ranges from about 4 wt. % to about 7 wt. % based on the total weight of the body.

5. The building panel according to claim 1, wherein the fiber is an inorganic fiber selected from the group consisting of mineral wool, fiberglass, and combinations thereof.

6. The building panel according to claim 1, wherein the body has an airflow resistance less than about 200 MKS rayls as measured between the first major surface and the second major surface.

7. The building panel according to claim 1, wherein the body has a bulk density ranging from about 0.15 g/cm$^3$ to about 0.3 g/cm$^3$ as measured between the first major surface, the second major surface, and the plurality of side surfaces.

8. The building panel according to claim 1, wherein the ionic charge-modifying component comprises hydrated potassium aluminum sulfate.

9. A building panel comprising a body, the body comprising:

an inorganic fiber in an amount ranging from about 70 wt. % to about 95 wt. % based on the total weight of the body;

a latex binder in an amount ranging from about 3 wt. % to about 10 wt. %; and an inorganic particle comprising kaolin present in an amount ranging from about 3 wt. % to about 30 wt. % based on the total weight of the body, wherein the kaolin particle has an average size ranging from about 8 micron to about 13 microns; and wherein the body comprises a first major surface opposite a second major surface and a plurality of side surfaces extending between the first major surface and the second major surface, wherein the body has a porosity ranging from about 80% to about 98% as measured between the first major surface, the second major surface, and the plurality of side surfaces; and wherein the body has an airflow resistance less than about 200 MKS rayls as measured between the first major surface and the second major surface.

10. The building panel according to claim 9, wherein the amount of the inorganic particle ranges from about 6 wt. % to about 25 wt. % based on the total weight of the body.

11. The building panel according to claim 9, wherein the latex binder comprises a polymer having a glass transition temperature ranging between about 60° C. and about 120° C.

12. The building panel according to claim 9, wherein the inorganic fiber is selected from the group consisting of mineral wool, fiberglass, and combinations thereof.

13. The building panel according to claim 9, wherein the inorganic particle further comprises calcium carbonate.

14. The building panel according to claim 9, wherein the body further comprises an ionic charge-modifying component selected from aluminum sulfate, poly(diallyldimethylammonium chloride), or a combination thereof.

15. The building panel according to claim 14, wherein the ionic charge-modifying component is present in an amount ranging from about 20 wt. % to about 70 wt. % based on the total weight of the latex binder.

16. A building panel comprising a body having a first major surface opposite a second major surface, the body comprising:

an inorganic fiber;

a latex binder comprising a copolymer of poly(styrene-acrylate);

calcium carbonate particle having an average size of about 5 microns;

an ionic charge-modifying component comprising poly (diallyldimethylammonium chloride) present in an amount ranging from about 0.1 wt. % to about 4.0 wt. % based on the total dry-weight of the body; and wherein the calcium carbonate particle and the latex binder are present in a weight ratio of about 3:1, and wherein the body has an airflow resistance less than about 200 MKS rayls as measured between the first major surface and the second major surface.

17. The building panel according to claim 16 having an NRC ranging from about 0.6 to about 0.99.

18. The building panel according to claim 1 having an NRC ranging from about 0.6 to about 0.99.

* * * * *